US005196064A

United States Patent [19]

Branderhorst et al.

[11] Patent Number: 5,196,064

[45] Date of Patent: Mar. 23, 1993

[54] REPLACEABLE FLUID DISPENSING NOZZLE

[75] Inventors: Everett J. Branderhorst, Portland; Jose Y. Gonzales, Aloha, both of Oreg.

[73] Assignee: Intel Corporation, Santa Clara, Calif.

[21] Appl. No.: 811,167

[22] Filed: Dec. 19, 1991

[51] Int. Cl.[5] ..... B05B 7/00

[52] U.S. Cl. ..... 118/313; 239/600

[58] Field of Search ..... 118/300, 313; 222/71; 239/587.1, 600

[56] References Cited

U.S. PATENT DOCUMENTS 4,922,852 5/1990 Price ..... 118/323

*Primary Examiner*—W. Gary Jones
*Assistant Examiner*—Charles K. Friedman
*Attorney, Agent, or Firm*—Blakely, Sokoloff, Taylor & Zafman

[57] ABSTRACT

A nozzle assembly for use in a semiconductor fabrication liquid dispensing apparatus which dispenses a liquid onto a surface. The nozzle assembly comprises a bulkhead comprised of a non-stick material (such as Teflon ® or similar material) coupled at a first end to a dispensing tube. The nozzle is removable and reusable so that an inventory of replaceable nozzles may be kept on hand for optimum operation of a liquid dispensing apparatus.

7 Claims, 4 Drawing Sheets

REPLACEABLE FLUID DISPENSING NOZZLE

BACKGROUND OF THE INVENTION

1. Field of the Invention

The present invention relates to the field of semiconductor fabrication. More specifically, the present invention relates to a nozzle assembly for delivery of a liquid (for example, photoresist) for use in semiconductor fabrication.

2. Background of Related Art

One of the apparatuses used in the fabrication of semiconductors is a spin track which deposits a certain amount of chemicals onto a wafer (such as photoresist) during manufacturing. Wafers proceed through the spin track, and a certain amount of photoresist (a photo sensitive chemical used to transfer circuit features from a mask to the wafer), is deposited upon the wafer. The wafer is then spun to make an even coating of the liquid applied across the surface of the wafer. Then, the wafers proceed through remaining steps in the manufacturing process to process the wafer and form the integrated circuit or other device. Several steps are involved in manufacturing a semiconductor in this fashion. However, significant periods of time lapse between when a first batch is run through the spin track machine, and a subsequent batch is run. In addition to resist, such machines are also used for depositing other chemicals including polyimide.

Because a substantial period of time may elapse between when one batch of wafers is run through the machine and a subsequent batch, there are times when the machine remains idle. If more than ten minutes elapse between batches, the remaining fluid in the nozzle portion of the apparatus starts to dry causing a residue to build up in the outlet of the dispensing tube. Once the remaining fluid at the end of the dispense tube has started to dry, a cleaning procedure is required in order to ensure that the fluid is evenly dispensed and no particles contaminate the wafers being processed. One prior art method for removing dried photoresist from the dispensing tube is to inject a solvent into the dispensing tube to remove any dried resist. Then, "dummy wafers" are run through the spin track apparatus and liquid is dispensed so that the solvent injected into the dispensing tube is purged. The dummy wafers are refused after cleaning for the next time that the resist needs to be removed from the apparatus. A considerable amount of labor, equipment, and materials is consumed by this cleaning process.

Yet another prior art approach is a swing arm dispensing tube. The swing arm is moved over a solvent drain and the liquid is dispensed through the tube until all the dried residue has been removed from the fluid path. This approach is effective, however, because chemicals such as photoresist are very expensive and a large quantity is typically required to purge all the remaining dried resist in the dispensing tube, this is an expensive solution.

Yet another problem with prior art methods is that the dispensing tubes tend to be bent, and thus become off center from the optimum position from which the chemical is to be dispensed. An off center dispensing nozzle from the optimum fluid deposition center is directly related to material yield loss.

In addition, prior art dispensing tubes have the tendency to migrate fluid to the flat surface of the dispense tube. The fluid dries and can cause particulate contamination to the subsequent wafers.

SUMMARY AND OBJECTS OF THE INVENTION

One of the objects of the present invention is to provide a liquid dispensing nozzle for use in semiconductor fabrication equipment which eliminates dried particulate contamination and reduces labor and materials required to deal with dried liquid problems.

Another of the objects of the present invention is to provide a nozzle for depositing fluid in a semiconductor processing environment which is relatively immune from being bent off center.

Another object of the present invention is to reduce the amount of time that a liquid dispensing apparatus is idle due to cleaning of the apparatus which must be performed.

Another object of the present invention is to provide a means for dispensing liquid in semiconductor fabrication to reduce the cost and time involved for cleaning the dispensing apparatus.

Another of the objects of the present invention is to reduce the problems caused by cleaning liquid dispensing nozzles for semiconductor fabrication equipment.

These and other objects of the present invention are provided for by a nozzle assembly for use in a semiconductor fabrication liquid dispensing apparatus which dispenses a liquid onto a surface. The nozzle assembly comprises a bulkhead comprised of a non-stick material (such as Teflon—polytetrafluorethylene—or similar material) coupled at a first end to a dispensing tube. The bulkhead contains a fluid flow path to receive fluid from the dispensing tube. The bulkhead is typically threaded and mates with the a holding cap which may be torqued to cause the bulkhead to be secured to the dispensing tube. The device further comprises a bridge plate with a bore for receiving the bulkhead. The bridge plate resides at a fixed distance from the surface. A nozzle is further coupled to a second end of the bulkhead, the nozzle also being comprised of Teflon or other similar non-stick material. The nozzle comprises an orifice for letting fluid from the dispensing tube exit out the orifice, and has a 45 degree angle in adjacent to the orifice to eliminate fluid migration and evaporation causing dried particulates to form, thus contaminating the fluid flow. The nozzle is removable and reusable so that an inventory of replaceable nozzles may be kept on hand for optimum operation of a liquid dispensing apparatus.

BRIEF DESCRIPTION OF DRAWINGS

The present invention is illustrated by way of example and not limitation of the figures of the accompanying in which like references indicate like elements and in which.

DETAILED DESCRIPTION

Figure 1:
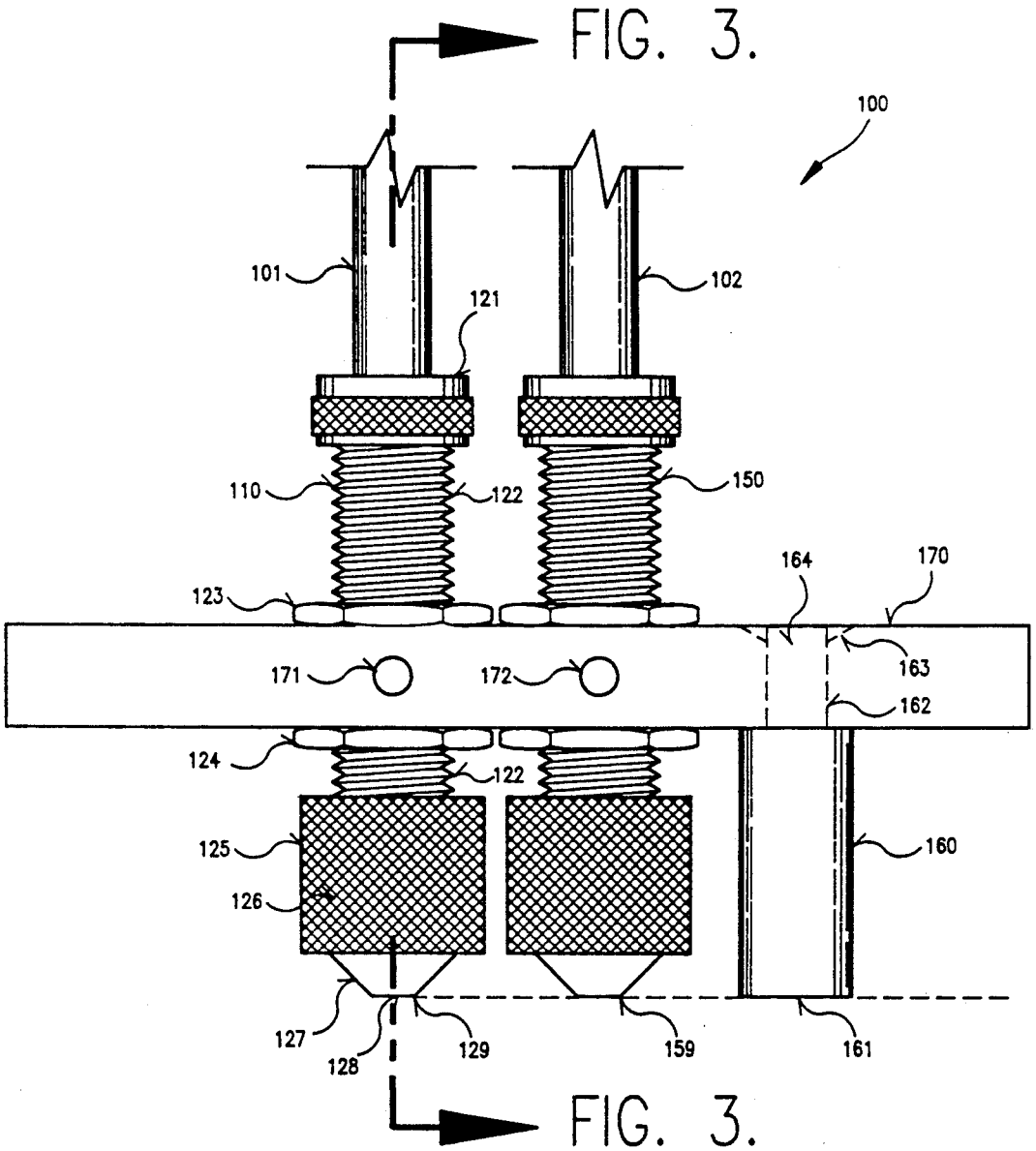
FIG. 1 shows an external view of the improved dispensing nozzle apparatus of the preferred embodiment.

The liquid dispensing nozzle apparatus of the preferred embodiment is shown as 100 in FIG. 1. 100 is typically used for dispensing chemicals used in semiconductor fabrication such as photoresist, polyimide, or spin on glass (SOG), among other liquids used in semiconductor fabrication. It will be apparent to one skilled in the art, however, that this improved nozzle apparatus may have equal application to any other area in which liquids are dispensed and have the tendency to dry and cause clogging and contamination of the passageways leading out of the dispensing nozzle. The apparatus comprises two nozzle assemblies 110 and 150, through which the liquid may flow and be dispensed to wafers during fabrication. Assembly 100 further comprises a bridge plate 170 for securing the nozzle assemblies 110 and 150 and holding them in a stable and secure position relative to the awaiting wafers. Also, bridge plate 170 prevents dispensing nozzle assemblies 110 and 150 from being knocked out of alignment with respect to one another. In addition, to facilitate easy vertical alignment of the nozzle tips 129 and 159 with respect to the wafers during fabrication, an alignment peg 160 is affixed to bridge plate 170 via an orifice 161. A detailed description of the nozzle assemblies and the alignment thereof will now be discussed.

Figure 3:
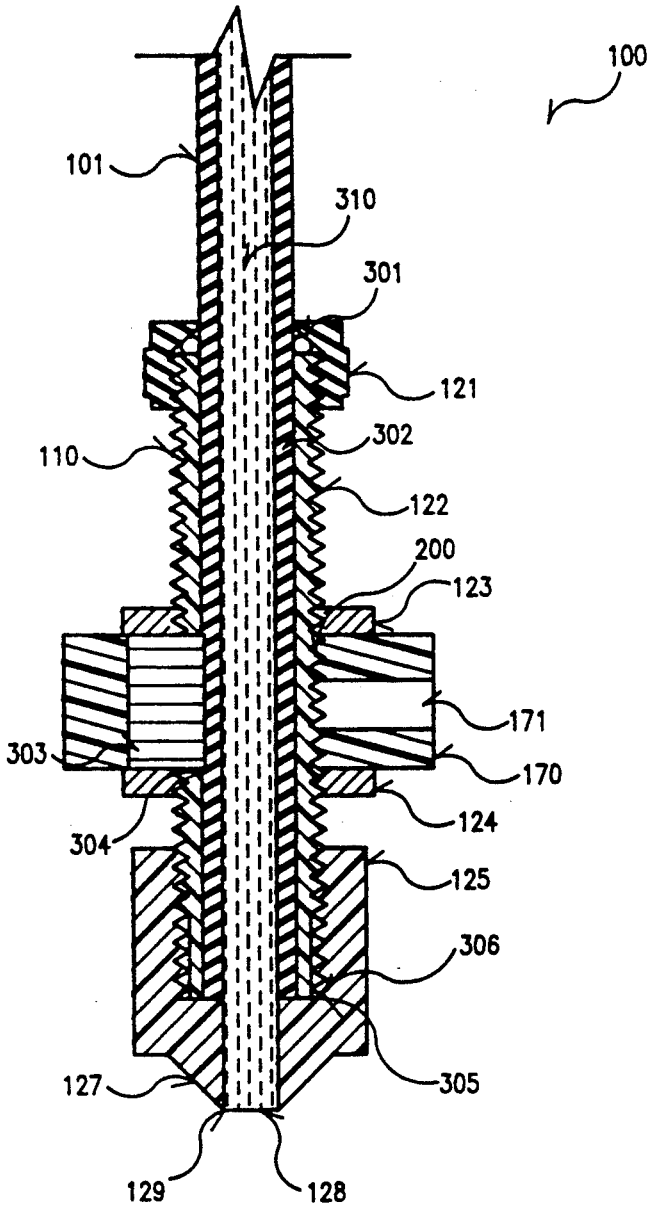
FIG. 3 shows a sectional side view of one dispensing nozzle assembly.

Nozzle assemblies 110 and 150 are essentially identical, so for the remainder of this application, only 110 will be discussed. Nozzle assembly 110 is attached to the end of the existing dispensing tube 101 shown in FIG. 1 of the chemical dispensing apparatus using friction via cap 121. A detailed view of nozzle assembly 110 is shown in FIG. 3 and will be discussed below. 121 is a standard threaded polypropylene cap commercially available. Nozzle assembly 110 comprises a threaded bulkhead 122 to which cap 121 is affixed and which encloses the existing dispensing tube 101. Bulkhead 122 is affixed to bridge plate 170 using standard polypropylene nuts 123 and 124 which are commercially available. The use of bulkhead 122 and nuts 123 and 124 allows fine adjustment of the position of bulkhead 122 and thus nozzle 125 with respect to bridge plate 170 so that the dispensing nozzle assemblies 110 and 150 may be precisely positioned with respect to the wafer surface below apparatus 100 in the spin track machine. Bridge plate 170 sits in a track in the chemical dispensing apparatus (not shown) and provides a fixed position above the spin track on which the wafers travel. Bulkhead 122 is comprised of a Delrin® brand material or similar material having non-stick surface characteristics.

Attached to bulkhead 122 of nozzle assembly 110 is dispensing nozzle 125. Nozzle 125 comprises a threaded portion which mates with 122 for a tight fit. This will be discussed in more detail with reference to FIG. 3 below. Nozzle 125 comprises a knurled exterior portion 126 (FIG. 1), which provides for easy manipulation by operators wearing gloves in clean room semiconductor fabrication facilities. Therefore, during a nozzle assembly exchange, the fabrication technician may easily manipulate and tighten nozzle 125 with respect to bulkhead 122. Further, nozzle 125 comprises an angled portion 127 which is adjacent to the outlet orifice 128 for dispensing nozzle 125 so that horizontal resist migration is eliminated. The 45° angled portion 127 of nozzle 125 provides a distinct advantage over the prior art flat dispensing tube outlet of the prior art in that the effect of surface tension is minimized in the area of orifice 128. Because surface tension is minimized, fluid migration may not occur in the area of orifice 128. Therefore, fluid cannot occur causing the chemical to dry outside of orifice 128 and therefore contaminate the fluid path. This prevents irregular fluid deposits upon wafers during manufacturing. This also prevents contaminants from getting into the chemical in nozzle assembly 110. Nozzle 125 is comprised of a Teflon® brand material (polytetrafluorethylene) or another material having similar non-stick characteristics. Residue buildup is minimized in the interior of nozzle 125, and also easy cleaning is provided by this non-stick surface when nozzle 125 is removed from bulkhead 122 or 150 of the chemical dispensing machine.

Nozzle assemblies 110 and 150 are attached to bridge plate 170 as shown in FIG. 1 using bulkhead nuts such as 123 and 124. These keep the separate nozzle assemblies in a fairly rigid and firm orientation with respect to one another in the horizontal plane and the wafers passing by on the spin track in the vertical plane. Bridge plate 170 therefore helps prevent the misalignment of the dispensing nozzle assemblies 110 and 150. In order to further aid the user for alignment of tips 129 and 159 of the nozzles in the vertical plane with respect to the spin track and thus the wafers being manufactured, the end 164 of an alignment peg 160 is fixed into bore 162 in bridge plate 170 to provide a guide to the operator during nozzle assembly installation and alignment. Alignment peg 160's tip 161 is at an optimum distance for the nozzle tips 129 and 159 for dispensing liquid onto wafers passing on the wafer spin track below. One end portion 162 of alignment peg 160 is attached with a countersunk screw 164 to provide a fixed position relative to 170. The tip 161 of alignment peg 160 is aligned with the plane of the two ends of the nozzles 129 and 159. A flat surface may be placed against the peg, and the nozzle assemblies 110 and 150 are adjusted using nuts such as 123 and 124 prior to installation onto the liquid dispensing tubes 101 and 102 of the chemical dispensing apparatus. This is done until the two tips of the nozzles 129 and 159 reside in the same plane as the tip of the alignment peg 161 using a flat surface. Once installed and properly adjusted, only the replacement of nozzle 125 is required for continued dispensing operation and no dummy wafers need be run through the machine.

Bridge plate 170 further comprises two alignment holes 171 and 172 shown in FIG. 1 which mate with a spring-loaded pin in the liquid dispensing apparatus. This holds the appropriate nozzle in a fixed position in the horizontal plane with respect to the wafers. The two nozzle assemblies 110 and 150 may be used for dispensing different types of photoresist or other chemical. An operator may withdraw the spring-loaded pin from a hole such as 171 or 172, depending on the operating mode, to switch to the other nozzle assembly for depositing a different type of chemical. For instance, a nozzle assembly such as 110 may deposit a type 40 photoresist liquid, and nozzle assembly 150 may dispense a type 15 photoresist chemical. If type 40 photoresist chemical is being dispensed, the pin is inserted into orifice 128 for keeping the bridge plate and thus nozzle assembly 110 stable with respect to the wafer path. If the operator desires to switch to type 15 photoresist material, then the spring-loaded pin is withdrawn from orifice 171, and bridge plate 170 is moved until the pin pops into orifice 172. Then, the apparatus may dispense type 15 photoresist material from nozzle assembly 150 onto wafers on the spin chuck.

Figure 2:
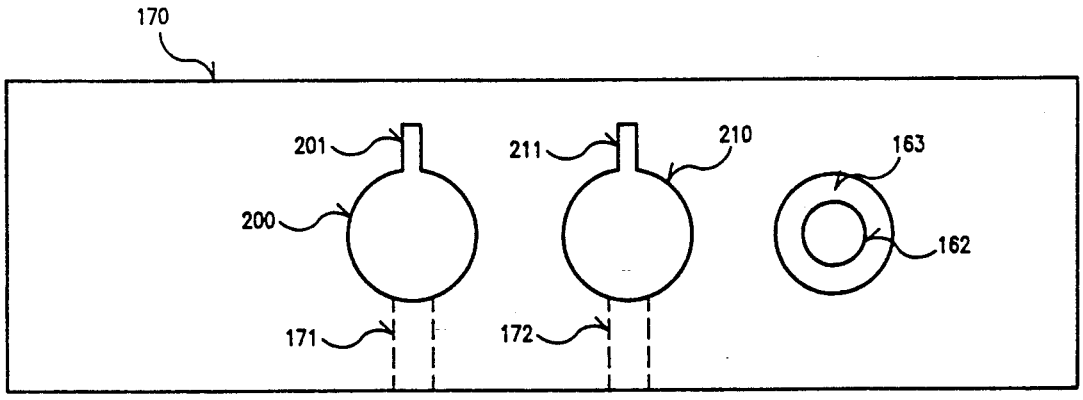
FIG. 2 shows a top view of the bridge plate portion of the dispensing nozzle apparatus.

A top view of bridge plate 170 is shown in FIG. 2. As shown in FIG. 2, bridge plate 170 comprises two bores 200 and 210 for receiving bulkheads such as 122 of nozzle assemblies 110 and 150 shown in FIG. 1. In addition, coupled to bores 200 and 210 are "keyways" or slots 201 and 211 coupled to bores 200 and 210. These keyways are slots to accept a "key" or rectangular piece of material which may be inserted with the bulkhead slot 304 between nuts such as 123 and 124. This key 303 holds the nozzle assembly such as 110, in place when torquing down nozzle 125 during replacement. This prevents the entire assembly from rotating so that the alignment with respect to peg 160 shown in FIG. 1 will not be disrupted. Also, as shown in FIG. 2, the countersunk portion 163 of the screw orifice 162 is shown from its top view. This permits a flat head screw to be flush with bridge plate 170 surface, while holding alignment peg 160, for horizontal movement of bridge plate 170 without interference. In addition, pin apertures 171 and 172 are shown in FIG. 2 for receiving of the spring-loaded pin from the chemical dispensing apparatus. A more detailed sectional view of one nozzle assembly 110 is shown with reference to FIG. 3.

As shown in FIG. 3, when installed, a nozzle assembly such as 110 is affixed to dispensing tube 101 and bridge plate 170. As discussed previously, dispensing tube 101 is secured to the nozzle assembly 110 using a holding cap 121. Bulkhead 122 of nozzle assembly 110 is secured to the dispensing tube 101 by torquing down the holding cap 121 such that the gripper ring 301 is directed inward by the interior angled portion of holding cap 121. The friction between the gripper ring 301 and dispensing tube 101 secures dispensing tube 101 to bulkhead 122. In addition, bridge plate 170 secures apparatus 100 with respect to the wafer position beneath dispensing nozzle assemblies 110 and 150. Also shown in FIG. 3 is orifice 171 for receiving the spring-loaded pin which secures the bridge plate in a horizontal plane with respect to the path of the wafers.

Figure 4A:
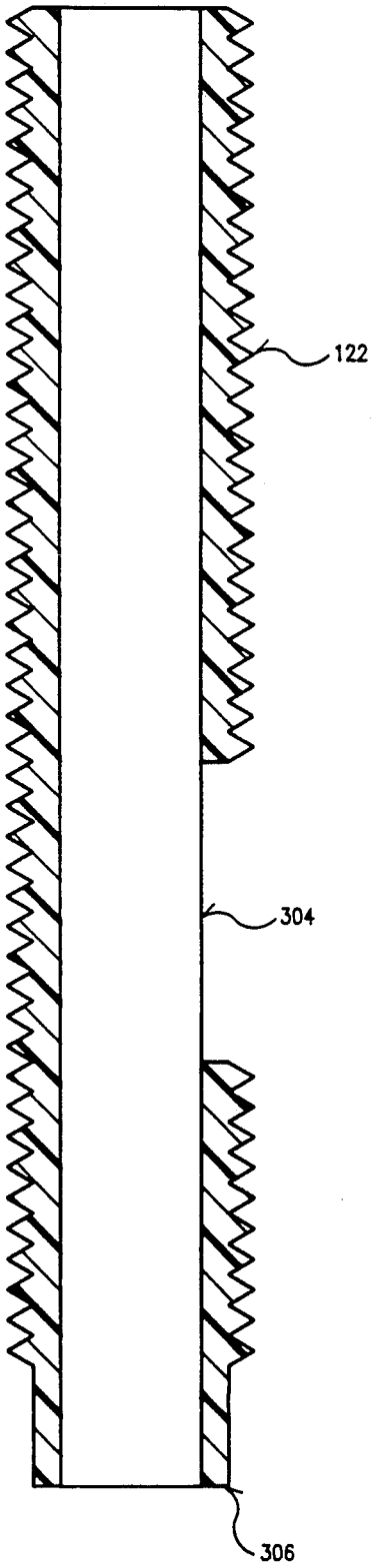
FIGS. 4A and 4B show a detailed sectional view of the nozzle and bulkhead portions of the dispensing nozzle assembly.
Figure 4B:
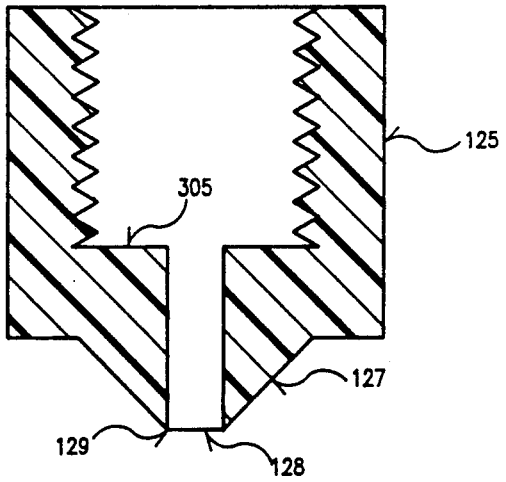

As discussed above, bulkhead nuts 123 and 124 secure bulkhead 122 to bridge plate 170. Fine adjustments of bulkhead 122 (and thus tip 129 of nozzle 125) may be performed by torquing nuts 123 and 124 in the appropriate direction. Bulkhead nuts 123 and 124 are threaded and mate with the threaded portion of bulkhead 122. An additional feature provided by the preferred embodiment is the use of a "key" for keeping the position of bulkhead 122 secure with respect to bridge plate 170. This key is shown as 303 in FIG. 3 and is comprised of stainless steel in one embodiment, but may be comprised of any similar rigid material. Key 303 is inserted into slot 201 and in bulkhead 122 so that the height of the assembly may be prevented from changing while torquing nozzle 125. Key 303 is inserted into a slot 304 in bulkhead 122 and the bulkhead 122 and key 303 combination is inserted into bore 200 mating 303 with keyway 201. More detailed views of bulkhead 122 and notch 304 are shown in FIGS. 4*a* and 4*b*. Key 303 is mated with the keyway 201 shown in FIG. 2 such that bulkhead 122 is held fixed with respect to the bridge plate 170. Nuts 123 and 124 are then torqued until the bulkhead is secure. The nozzle 125 is attached and rotated onto bulkhead 122 until the interior wall 305 of nozzle 125 is flush against the tip 306 of bulkhead 122. Because there are no gaps between the tip 306 of bulkhead 122 and inside wall 305 of nozzle 125, there is no air space for the liquid to accumulate and crystalize. This functions as a secondary liquid seal. Once bulkhead 122 has been inserted into bridge plate 170, and the nozzle 125 has been attached to bulkhead 122, assembly 100 may be mounted onto the liquid dispensing apparatus and dispensing tube 101 attached. Holding cap 121 may then be torqued, and nuts 123 and 124 may be used to finely adjust the position of the tip 129 of nozzle 125 for proper alignment with respect to tip 161 of alignment peg 160. During this fine adjustment, because key 303 resides in keyway 201 and notch 304 of bulkhead 122, bulkhead 122 is prevented from rotating with respect to bridge plate 170. Once the plane of nozzle assemblies 110 and 150 has been ascertained by the tip 161 of alignment peg 160, the nozzle assemblies may be held into a fixed position such as 110, and alignment nuts 123 and 124 may be torqued until bulkhead 122 is secure. Also, holding cap 121 may be torqued to secure nozzle assembly 110 to dispensing tube 101 so that dispensing tube 101 is under light compression between holding cap 121 and nozzle 125 for a strong primary liquid seal. Once alignment is complete, nozzle assembly 110 is ready for operation.

The diameter of orifice 128 is equal to the interior diameter of dispensing tube 101 to provide contiguous and non-turbulent flow of fluid. Because there are no gaps along the fluid flow path 310, there is nowhere for the fluid to accumulate, and therefore evaporation and crystalization of the chemical is minimized. In addition, due to the non-stick surface of bulkhead 122 and nozzle 125, residue buildup in the area of nozzle orifice 128 is resisted. The Teflon® brand material of the preferred embodiment is compatible with chemicals such as photoresist. Also, as mentioned previously, the 45° angle of portion 127 in the area of orifice 128 prevents the migration of fluid across a horizontal surface preventing evaporation and the generation of particulate contamination.

Another advantage is provided by the removable nature of nozzle 125 once apparatus 100 is installed. Multiple replaceable nozzles 125 may be kept on hand for easy replacement of existing dirty nozzles. Dirty nozzle 125 may be removed, cleaned, and reused. This substantially reduces the cost and the time involved in cleaning prior art dispensing tubes. Another advantageous feature of the preferred embodiment is a reduction in the use of expensive chemicals such as photoresist. This occurs because the resist need not be run on dummy wafers to purge prior art dispensing tube cleaning solvents. This is a substantial improvement over the prior art. As another advantage of the preferred embodiment, fewer dummy wafers need to be kept in the inventory. The elimination of the use of dummy wafers reduces cost.

In the foregoing specification, the present invention has been described with reference to specific embodiments thereof. It will, however, be evident that various modifications and changes may be made thereto without departing from the broader spirit and scope of the present invention as set forth in the appended claims. The specification and drawings are, accordingly, to be regarded in an illustrative rather than a restrictive sense.

What is claimed is:

1. A nozzle assembly for use in a semiconductor fabrication liquid dispensing apparatus which dispenses a liquid onto a surface comprising:

a. a bulkhead comprised of a non-stick material coupled at a first end to a dispensing tube of the liquid dispensing apparatus, the bulkhead containing an internal fluid flow path to direct fluid from the dispensing tube;

b. a holding cap which mates with the bulkhead such that when the holding cap is torqued the bulkhead becomes secured to the dispensing tube;

c. a bridge plate with a bore for receiving the bulkhead, the bridge plate residing a fixed distance from the surface; and d. a nozzle coupled to a second end of the bulkhead, the nozzle being comprised of the non-stick material, and comprising an orifice for letting fluid from the dispensing tube exit out the orifice.

2. The apparatus of claim 1 wherein the non-stick material comprises polytetrafluorethylene.

3. The apparatus of claim 1 wherein the bulkhead is threaded and the holding cap and nozzle are coupled to the bulkhead by mating with the threaded portion.

4. The apparatus of claim 3 wherein the bulkhead is couled to the bridge plate via nuts.

5. The apparatus of claim 4 further comprising a slot for a key which prevents the bulkhead from movement when the nuts are torqued.

6. The apparatus of claim 1 wherein the nozzle is reusable and replaceable.

7. The apparatus of claim 1 further comprising a slot for a key which prevents the bulkhead from movement when the nozzle is torqued.

* * * * *

UNITED STATES PATENT AND TRADEMARK OFFICE

CERTIFICATE OF CORRECTION

PATENT NO. : 5,196,064

DATED : 3/23/93

INVENTOR(S) : Everett J. Branderhorst and Jose Y. Gonzales

It is certified that error appears in the above-indentified patent and that said Letters Patent is hereby corrected as shown below:

Column 8, line 5, delete "couled" and insert --coupled--.

Signed and Sealed this

Twenty-second Day of February, 1994

*Attest:*

Bruce Lehman

BRUCE LEHMAN

*Attesting Officer*

*Commissioner of Patents and Trademarks*